US011830689B2

(12) United States Patent
Urayama et al.

(10) Patent No.: US 11,830,689 B2
(45) Date of Patent: Nov. 28, 2023

(54) OPERATION DEVICE

(71) Applicant: Alps Alpine Co., Ltd., Tokyo (JP)

(72) Inventors: Shinya Urayama, Miyagi-ken (JP); Yosuke Sasaki, Miyagi-ken (JP)

(73) Assignee: Alps Alpine Co., Ltd.

( * ) Notice: Subject to any disclaimer, the term of this patent is extended or adjusted under 35 U.S.C. 154(b) by 121 days.

(21) Appl. No.: 17/453,871

(22) Filed: Nov. 8, 2021

(65) Prior Publication Data

US 2022/0059303 A1 Feb. 24, 2022

Related U.S. Application Data

(63) Continuation of application No. PCT/JP2020/021667, filed on Jun. 1, 2020.

(30) Foreign Application Priority Data

Jun. 6, 2019 (JP) ..... 2019-106287

(51) Int. Cl.

| | |
|---|---|
| ***H01H 19/14*** | (2006.01) |
| ***H01H 25/00*** | (2006.01) |
| ***H01H 13/26*** | (2006.01) |
| ***H01H 19/10*** | (2006.01) |

(52) U.S. Cl.

CPC ..... *H01H 25/002* (2013.01); *H01H 13/26* (2013.01); *H01H 19/10* (2013.01)

(58) Field of Classification Search

CPC ..... H01H 19/14; H01H 19/11; H01H 19/585; H01H 19/58; H01H 19/62; H01H 19/635; H01H 19/64; H01H 19/63; H01H 19/005; H01H 19/10; H01H 1/2041; H01H 19/56; H01H 19/03; H01H 19/02; H01H 2019/006; H01H 19/00; H01H 19/20; H01H 19/001; H01H 21/50; H01H 2221/01

See application file for complete search history.

(56) References Cited

FOREIGN PATENT DOCUMENTS

| | | | | |
|---|---|---|---|---|
| EP | 3214631 A1 | | 9/2017 | |
| JP | H0652774 | * | 2/1994 | ..... H01H 50/305 |
| JP | H07-272592 A | | 10/1995 | |
| JP | 2004-021789 A | | 1/2004 | |
| JP | 2017-157429 A | | 9/2017 | |

OTHER PUBLICATIONS

International Serach Report for corresponding International Application No. PCT/JP2020/021667 dated Aug. 11, 2020 (2 Pages).

* cited by examiner

*Primary Examiner* — Ahmed M Saeed

(74) *Attorney, Agent, or Firm* — Harness, Dickey & Pierce, P.L.C.

(57) ABSTRACT

An operation device includes a support portion, a moving body operated by an operator and movably supported by the support portion, a detection unit that detects movement of the moving body, and contact portions respectively provided on the support portion and the moving body and brought into contact with each other. The contact portion of one of the support portion and the moving body has an elastic region that is first brought into contact with the contact portion of the other when the contact portions are brought into contact with each other and a rigid region provided adjacent to the elastic region and continuously brought into contact with the contact portion of the other following the contact of the elastic region to regulate the movement of the moving body.

9 Claims, 6 Drawing Sheets

OPERATION DEVICE

CLAIM OF PRIORITY

This application is a Continuation of International Application No. PCT/JP2020/021667 filed on Jun. 1, 2020, which claims benefit of Japanese Patent Application No. 2019-106287 filed on Jun. 6, 2019. The entire contents of each application noted above are hereby incorporated by reference.

BACKGROUND OF THE INVENTION

1. Field of the Invention

The present invention relates to an operation device.

2. Description of the Related Art

An operation device has been developed that includes a support portion, a moving body that is freely movably supported on the support portion in mutually orthogonal X and Y directions, and a detection member that detects the movement of the moving body in the X and Y directions. The operation device is characterized in that a guide recess extending in the X and Y directions is formed on one of a protruding portion formed on the moving body and the support portion, and a shaft body that moves in the guide recess is provided on the other. The protruding portion has a pair of side edges that are inclined with respect to both X and Y directions, and the shaft body is provided between the pair of the side edges (refer to, for example, Japanese Unexamined Patent Application Publication No. 2017-157429).

SUMMARY OF THE INVENTION

Existing operation devices are configured to regulate the movement of the moving body by bringing the protruding portion moving in the guide recess into contact with the inner wall of the guide recess, that is, by causing the moving body and the support portion to contact each other. However, the operation devices do not have a configuration to absorb the collision noise when the moving body and the support portion are brought into contact with each other.

Accordingly, the present invention provides an operation device capable of absorbing the collision noise when the moving body and the support portion are brought into contact with each other.

According to an embodiment of the present invention, an operation device includes a support portion, a moving body operated by an operator and movably supported by the support portion, a detection unit configured to detect movement of the moving body, and contact portions respectively provided on the support portion and the moving body. The contact portions are brought into contact with each other. The contact portion of one of the support portion and the moving body has an elastic region that is first brought into contact with the contact portion of the other when the contact portions are brought into contact with each other and a rigid region provided adjacent to the elastic region and continuously brought into contact with the contact portion of the other following the contact of the elastic region to regulate the movement of the moving body.

DESCRIPTION OF THE PREFERRED EMBODIMENTS

Embodiments of an operation device according to the present invention are described below.

First Embodiment

Figure 1:
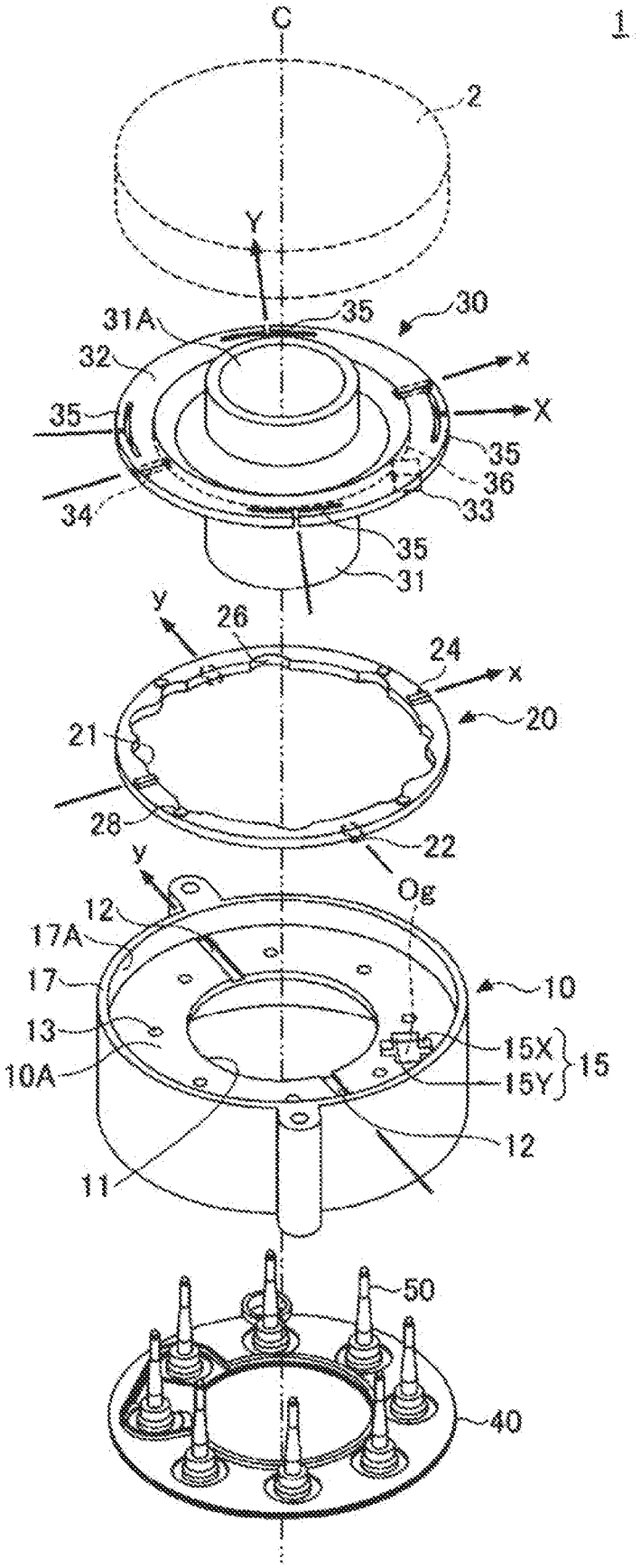
FIG. 1 is an exploded view of an operation device according to a first embodiment.

FIG. 1 is an exploded view of an operation device 1 according to the first embodiment. The operation device 1 illustrated in FIG. 1 can be used for, for example, in-vehicle electronic products, game machines, home electronic products, or industrial electronic products.

As illustrated in FIG. 1, the operation device 1 includes a support portion 10, an intermediate slide member 20, a moving body 30, a mat 40, and a detection unit 50. The moving body 30 is operated by an operator via an operating handle 2. The operating handle 2 can be operated in the ±X and ±Y directions, and the moving body 30 and the intermediate slide member 20 move relative to the support portion 10 in accordance with the operation performed on the operating handle 2.

Note that in the following description, the X and Y directions denoted with uppercase letters and the x and y directions denoted with lowercase letters are used. The X direction and Y direction are mutually orthogonal in an XY-plane, and the x direction and y direction are mutually orthogonal in an xy-plane. The XY-plane and xy-plane are parallel to each other. The X and Y directions in the XY-plane are directions rotated 22.5 degrees clockwise relative to the x- and Y directions. Hereinafter, the XY plane view is referred to as a "plan view". Note that although for convenience of description, the vertically structured relationship in FIG. 1 is used in the description below, it does not define a universal vertical relationship.

The support portion 10 is part of the case of one of various electronic devices and is a cylindrical member made of a synthetic resin, such as glass filled PBT (polybutylene terephthalate) or a die cast cylindrical member made of a lightweight alloy, such as aluminum alloy. The support portion 10 has a through-hole 11 formed at the center. The through-hole 11 passes through the support portion 10 in the vertical direction. The support portion 10 has a circular upper surface 10A in plan view, and a guide portion 12 is formed on the upper surface 10A so as to extend in the y direction. The guide portion 12 is a guide groove (or a guide rail). The guide portion 12 extends across the through-hole 11 in the Y direction, and two guide portions 12 are provided.

The support portion 10 further has a guide recess 15 that is provided on the upper surface 10A. The guide recess 15 has a guide portion 15X and a guide portion 15Y. The guide portion 15X extends in the ±X direction from a guide center Og located at the center of the guide recess 15, and the guide portion 15Y extends in the ±Y direction from the guide center Og. A protrusion 33 is provided on the lower surface of the moving body 30 so as to be inserted into the guide recess 15.

The support portion 10 further has a wall 17 that surrounds the upper surface 10A. The wall 17 is a cylindrical curved surface and has an inner peripheral surface 17A. When the moving body 30 is moved to the end in the ±X and ±Y directions, the moving body 30 is brought into contact with the inner peripheral surface 17A.

The intermediate slide member 20 is a ring-shaped member made of a synthetic resin, such as POM (polyacetal). The intermediate slide member 20 has an opening 21 in the center thereof, and the opening 21 passes through the intermediate slide member 20 in the vertical direction. A sliding part 22 is provided on the lower surface of the intermediate slide member 20. The sliding part 22 is a protrusion, and two of the sliding parts 22 are provided on either side of the opening 21 in the ±y directions.

When the intermediate slide member 20 is mounted on the upper surface 10A of the support portion 10, the sliding parts 22 are slidably inserted into the guide portions 12, respectively. The intermediate slide member 20 is supported on the upper surface 10A of the support portion 10 in a movable manner in the y direction by sliding the sliding parts 22 inside the guide portions 12. Note that the intermediate slide member 20 is movable only in the y direction and does not move in the X direction relative to the support portion 10.

A sliding part 24 is provided on the upper surface of the intermediate slide member 20. The sliding part 24 is a protrusion, and two sliding parts 24 are disposed on either side of the opening 21 in the ±x directions. In addition, eight recesses 26 are provided on the inner peripheral surface of the intermediate slide member 20 along the opening 21. Each of the recesses 26 is a portion where the inner peripheral surface of the intermediate slide member 20 extending along the opening 21 is partially rounded so as to be concave in plan view. The recesses 26 are provided to avoid the intermediate slide member 20 from being brought into contact with the detection unit 50 when the intermediate slide member 20 moves.

Note that the four protrusions 28 provided on the upper surface of the intermediate slide member 20 are portions at which the upper surface of the intermediate slide member 20 is in contact with the lower surface of the moving body 30. Only the protrusions 28 of the upper surface of the intermediate slide member 20 are in contact with the lower surface of the moving body 30 and, thus, the contact resistance is reduced.

The moving body 30 is made of a synthetic resin, such as POM (polyacetal). The moving body 30 is a member including a cylindrical cylinder 31 that passes through the center portion of a ring-shaped flange 32 in the vertical direction. The cylinder 31 has a through-hole 31A thereinside extending in the vertical direction.

A guide portion 34 is provided on the lower surface of the flange 32. The guide portion 34 is a guide groove, and two of the guide portions 34 are provided on either side of the cylinder 31 in the ±x directions. The guide portions 34 are provided at positions that sandwich the through-hole 31A so as to extend in the x direction and pass through a central axis C of the moving body 30. Note that the central axis C coincides with the central axis of the intermediate slide member 20 and the central axis of the through-hole 11 of the support portion 10 when the moving body 30 is not moved (in the neutral mode in which the amount of movement of the moving body 30 is zero).

The cylinder 31 of the moving body 30 is inserted into the opening 21 of the intermediate slide member 20 and is further inserted into the through-hole 11 of the support portion 10, and the lower surface of the flange 32 is mounted on the intermediate slide member 20. At this time, the sliding part 24 of the intermediate slide member 20 is inserted into the guide portion 34 on the lower surface of the flange 32, and the moving body 30 is supported on the intermediate slide member 20 in a freely movable manner in the x direction. The moving body 30 is free to move only in the x direction and not in the y direction relative to the intermediate slide member 20.

In addition, the moving body 30 has a leaf spring 35 on the outer periphery of the flange 32. The leaf spring 35 is provided to reduce collision noise (collision sound) when the flange 32 of the moving body 30 is brought into contact with the inner peripheral surface 17A of the wall 17 of the support portion 10. The leaf spring 35 is described in more detail below with reference to FIG. 2 and FIGS. 3A to 3C.

The moving body 30 has a cam portion 36 that is provided around the cylinder 31 on the lower surface of the flange 32. The cam portion 36 is ring-shaped and has a cam surface that is inclined in the radial direction of the flange 32. The cam surface of the cam portion 36 is inclined so as to be located downward toward the inner side in the radial direction. The cam portion 36 is brought into contact with the detection unit 50 and urges the detection unit 50 downward when the moving body 30 moves in the X and Y directions. The upper surface in the center of the flange 32 has a downgage recess with a shape corresponding to the shape of the cam portion 36 provided on the lower surface and is inclined downward toward the inner side in the radial direction.

After the intermediate slide member 20 and the moving body 30 are assembled on the support portion 10, the moving body 30 can be moved in the xy plane relative to the support portion 10 by sliding the intermediate slide member 20 in the y direction and sliding the moving body 30 on the intermediate slide member 20 in the x direction. Accordingly, the diameter (the outer diameter) of the cylinder 31 of the moving body 30 is less than the opening diameter of the through-hole 11 of the support portion 10 and is less than the inner diameter of the opening 21 of the intermediate slide member 20, so that the cylinder 31 is movable in any direction in the xy plane. A retaining mechanism (not illustrated) is provided at the lower part of the support portion 10 to prevent the cylinder 31 from slipping out of the through-hole 11 upward.

In addition, the protrusion 33 provided on the lower surface of the moving body 30 is inserted into the guide recess 15 provided on the upper surface 10A of the support portion 10, and the movement direction of the moving body 30 relative to the support portion 10 is regulated to the two axial directions (the X direction and the Y direction).

When the operating handle 2 is moved in the X direction, the protrusion 33 moves within the guide portion 15X of the guide recess 15, and the movement of the intermediate slide member 20 in the y direction and the movement of the moving body 30 in the x direction achieve the movement of the operating handle 2 in the X direction.

When the operating handle 2 is moved in the Y direction, the protrusion 33 moves within the guide portion 15Y of the guide recess 15, and the movement of the intermediate slide member 20 in the y direction and the movement of the moving body 30 in the x direction achieve the movement of the operating handle 2 in the Y direction.

Note that the lengths of the guide portions 15X and 15Y from the guiding center Og in the X and Y directions, respectively, are set to be greater than the distance between the flange 32 and the inner peripheral surface 17A in the mode in which the moving body 30 is not moved (the neutral mode in which the amount of movement of the moving body 30 is zero). For this reason, when the moving body 30 is moved in the X and Y directions, the outer peripheral surface of the flange 32 is brought into contact with the inner peripheral surface 17A, and the projection 33 is not brought into contact with the ends of the guide portions 15X and 15Y in the ±X and ±Y directions.

The mat 40 is a rubber member and holds eight detection units 50 such that the detection units 50 are movable in the vertical direction. The detection units 50 pass through through-holes 13 provided in the upper surface 10A of the support portion 10 so that the tips of the detection units 50 protrude from the upper surface 10A. When the moving body 30 moves due to the movement of the operating handle 2, the tip of the detection unit 50 located in the movement direction is pressed downward by the cam portion 36 of the moving body 30, and a point of contact provided under the detection unit 50 enters a conductive mode.

The detection unit 50 is a rod-shaped switch, which, when pressed downward, causes the point of contact (not illustrated) provided under the detection unit 50 to enter the conductive mode. The detection units 50 are arranged on the same circumference around the central axis of the through-hole of the support portion 10 at equal intervals. Four of the eight detection units 50 are located on the X-axis and the Y-axis. When the moving body 30 is moved in the X direction, either of the two detection units 50 on the X-axis is pressed. When the moving body 30 is moved in the Y direction, either of the two detection units 50 on the Y-axis is pressed.

The other four detection units 50 are provided in case the moving body 30 is made movable in four axial directions by providing guide portions in the 45-degree directions between the X- and Y-axes in addition to the guide portions 15X and 15Y of the guide recess 15. For this reason, when the guide portions 15X and 15Y are used to regulate the movement direction of the moving body 30 in the two axial directions, that is, the X and Y directions, four detection units 50 on the X- and Y-axes are sufficient.

The operating handle 2 is mounted on top of the moving body 30. The operating handle 2 and the moving body 30 move together in the X and Y directions. The operating handle 2 is supported so as to be pressable in the vertical direction of the moving body 30 and be freely rotatable. A pressure detection unit and a rotation detection unit (neither is illustrated) are provided inside the through-hole 31A of the moving body 30. When the operating handle 2 is pressed on the moving body 30, the pressure detection unit operates. When the operating handle 2 is rotated, the rotation detection unit operates.

Figure 2:
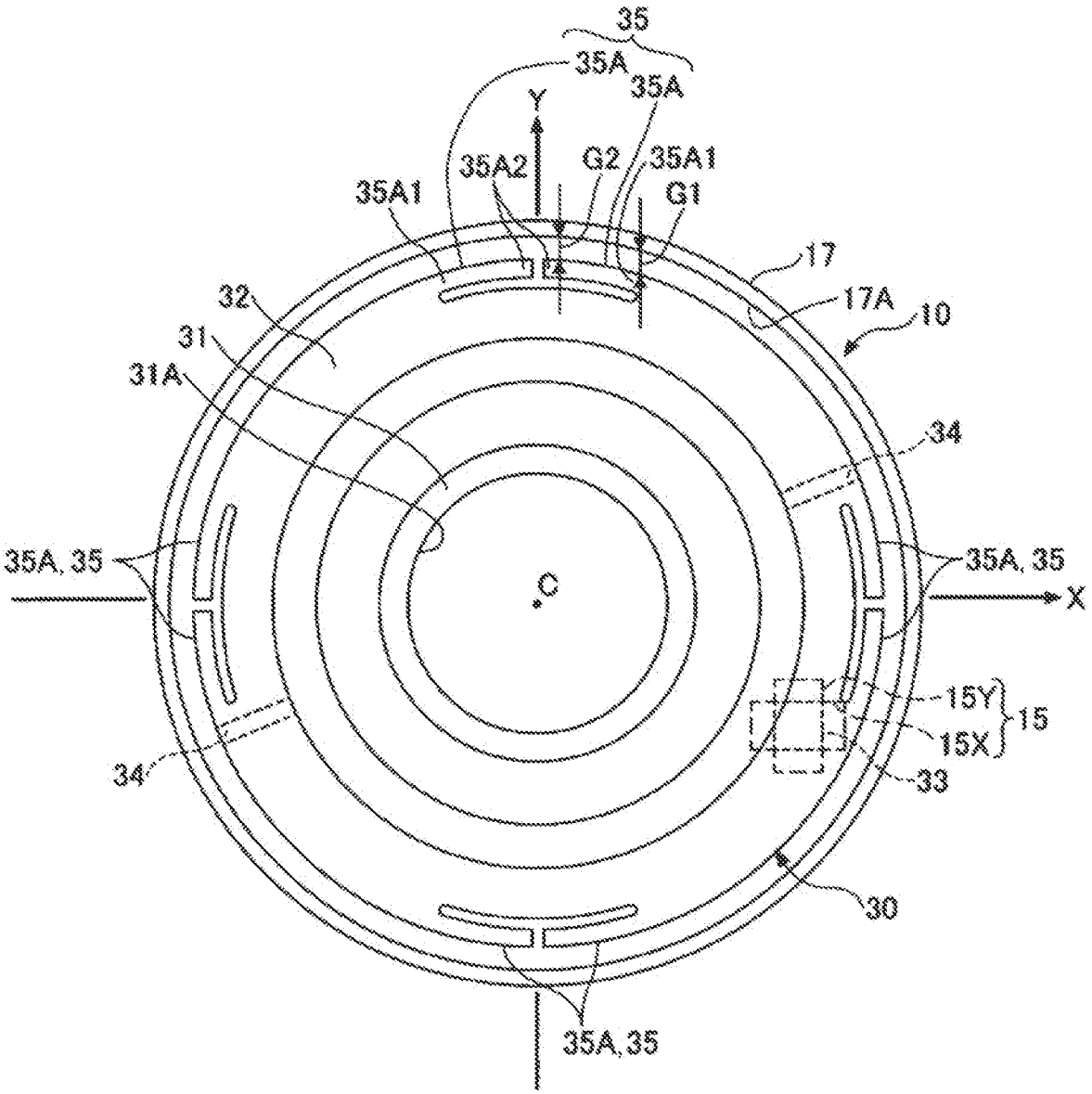
FIG. 2 is a plan view of a moving body.

FIG. 2 is a plan view of the moving body 30. FIG. 2 illustrates the wall 17 of the support portion 10 and the moving body 30.

The leaf springs 35 of the moving body 30 are provided at two locations in the outer periphery of the flange 32 in the ±X direction and two locations in the ±Y direction. The number of leaf springs 35 is four. Since the moving body 30 is movable in the ±X and ±Y directions relative to the wall 17, the four leaf springs 35 are brought into contact with the portions of the inner peripheral surface 17A of the wall 17 on the X-axis and their vicinities and, in addition, the portions of the inner peripheral surface 17A of the wall 17 on the Y-axis and their vicinities.

For this reason, each of the leaf springs 35 is a contact portion that is provided in the moving body 30 and that is brought into contact with a contact portion of the support portion 10 and is an example of a "contact portion of one of the support portion and the moving body". In addition, the portion of the inner peripheral surface 17A of the wall 17 on the X-axis and its vicinity or the portion of the inner peripheral surface 17A of the wall 17 on the Y-axis and its vicinity are a contact portion that is provided in the support portion 10 and that is brought into contact with the contact portion of the moving body 30 and is an example of a "contact portion of the other of the support portion and the moving body".

The leaf spring 35 is provided as an integral part of the flange 32 of the moving body 30, and the portion of the inner peripheral surface 17A of the wall 17 on the X-axis and its vicinity and the portion of the inner peripheral surface 17A of the wall 17 on the Y-axis and its vicinity are provided as integral parts of the support portion 10.

In addition, the leaf spring 35 is provided on the substantially cylindrical outer peripheral surface of the moving body 30, and the portions of the inner peripheral surface 17A of the wall 17 on the X-axis and their vicinities and the portions of the inner peripheral surface 17A of the wall 17 on the Y-axis and their vicinities are provided in the inner peripheral surface 17A of the substantially cylindrical wall 17 that surrounds the moving body 30 of the support portion 10.

Since the configurations of all four leaf springs 35 are the same, the leaf spring 35 located in the +Y direction is described below.

The leaf spring 35 has two leaf spring portions 35A that are provided across the Y-axis. The two leaf spring portions 35A are provided so as to be line symmetrical about the Y-axis. The leaf spring portions 35A are elastically deformable in the radially inward direction of the flange 32 (in the movement direction of the moving body 30). The symmetrical axis is an imaginary center line extending between the two leaf spring portions 35A.

The leaf spring portion 35A extends along the outer periphery of the flange 32, from a base part 35A1 connected to the flange 32 to a tip part 35A2. Each of the leaf spring 35 and the leaf spring portions 35A is an example of an elastic region. The base part 35A1 is an attaching portion (a connecting portion) that attaches one end of the leaf spring portion 35A to the flange 32 and supports the end. In addition, since the base part 35A1 is not elastically deformed in the radial direction of the flange 32 and has rigidity (is a rigid body), the base part 35A1 is an example of a rigid region that is provided adjacent to the elastic region and that regulates the movement of the moving body 30.

The two leaf spring portions 35A have a shape formed by providing a substantially T-shaped slit in the outer periphery of the circular flange 32 in plan view. Accordingly, the tip parts 35A2 of the two leaf spring portions 35A are disposed so as to face each other in the outer periphery direction of the flange 32, and the Y-axis passes through the middle point between the tip parts 35A2 of the two leaf spring portions 35A.

In addition, the leaf spring portion 35A has an outer peripheral surface (an example of an outer surface of one of the contact portions) formed thereon. The outer peripheral surface is located on the radially outer side along an imaginary outer peripheral circle of the flange 32 as the outer peripheral surface extends from the base part 35A1, which is located on the imaginary outer peripheral circle of the flange 32, toward the tip part 35A2. In addition, the outer peripheral surface of the leaf spring portion 35A (the surface that is brought into contact with the inner peripheral surface 17A) is a continuously curved surface from the base part 35A1 to the tip part 35A2. Note that the term "imaginary outer peripheral circle of the flange 32" refers to a circle that spans the outer periphery of a zone where the leaf spring 35 is not provided.

More specifically, the leaf spring portion 35A is formed along the imaginary outer peripheral circle of the flange 32 so as to extend from the base part 35A1 to the tip part 35A2, and the radius of the outer peripheral surface of the leaf spring portion 35A is less than that of the inner peripheral surface 17A (the curvature of the outer peripheral surface of the leaf spring portion 35A is greater than that of the inner peripheral surface 17A). Consequently, as illustrated in FIG. 2, in the mode in which the moving body 30 is not moved (the neutral mode in which the amount of movement of the moving body 30 is zero), a distance G1 between the base part 35A1 and the inner peripheral surface 17A is greater than a distance G2 between the tip part 35A2 and the inner peripheral surface 17A, and the distance between the leaf spring portion 35A extending from the tip part 35A2 to the base part 35A1 and the inner peripheral surface 17A continuously increases from G2 to G1.

That is, as illustrated in FIG. 2, in the mode in which the moving body 30 is not moved (the amount of movement of the moving body 30 is zero), the distance G2 between the tip part 35A2 and the inner peripheral surface 17A (the distance in the Y-axis direction) is less than the distance G1 between the base part 35A1 and the inner peripheral surface 17A (the distance in the Y-axis direction), and the distance between the leaf spring portion 35A extending from the base part 35A1 to the tip part 35A2 and the inner peripheral surface 17A continuously decreases from G1 to G2.

Due to the configuration, when the moving body 30 is moved in the +Y direction and, thus, the leaf spring portion 35A moves closer to the inner peripheral surface 17A, the tip part 35A2 is first brought into contact with the inner peripheral surface 17A and, thereafter, the outer peripheral surface of the section of the leaf spring portions 35A from the tip part 35A2 to the base part 35A1 is continuously brought into contact with the inner peripheral surface 17A, causing the leaf spring portion 35A to gradually bend radially inward.

Figure 3A:
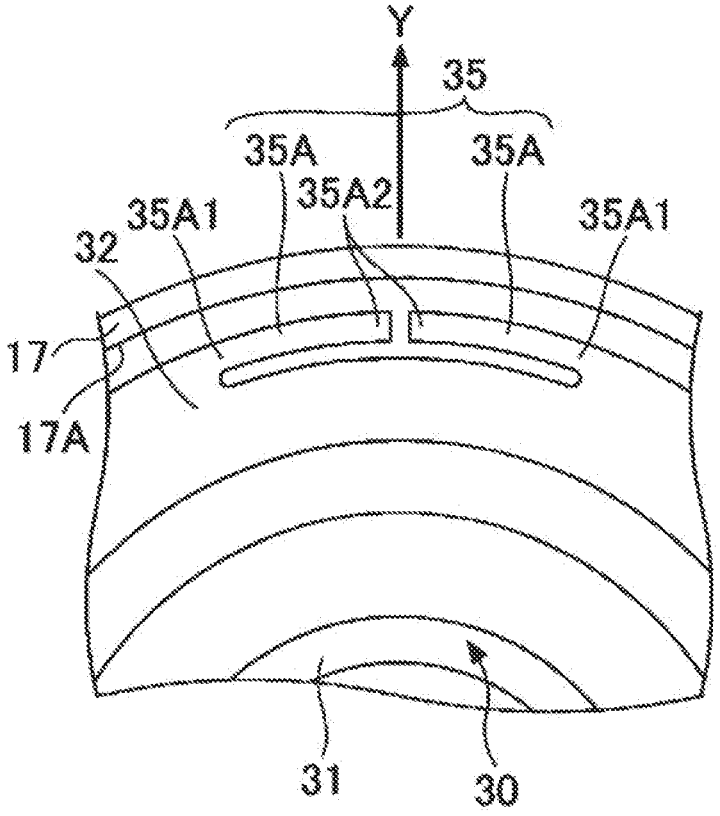
FIG. 3A is an enlarged view illustrating the operation performed by the moving body.
Figure 3B:
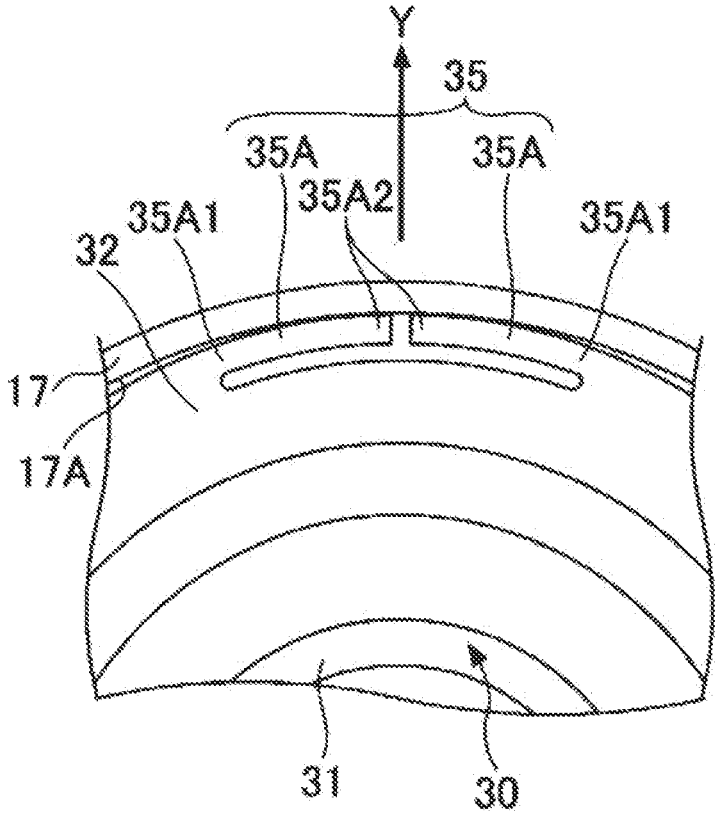
FIG. 3B is an enlarged view illustrating the operation performed by the moving body.
Figure 3C:
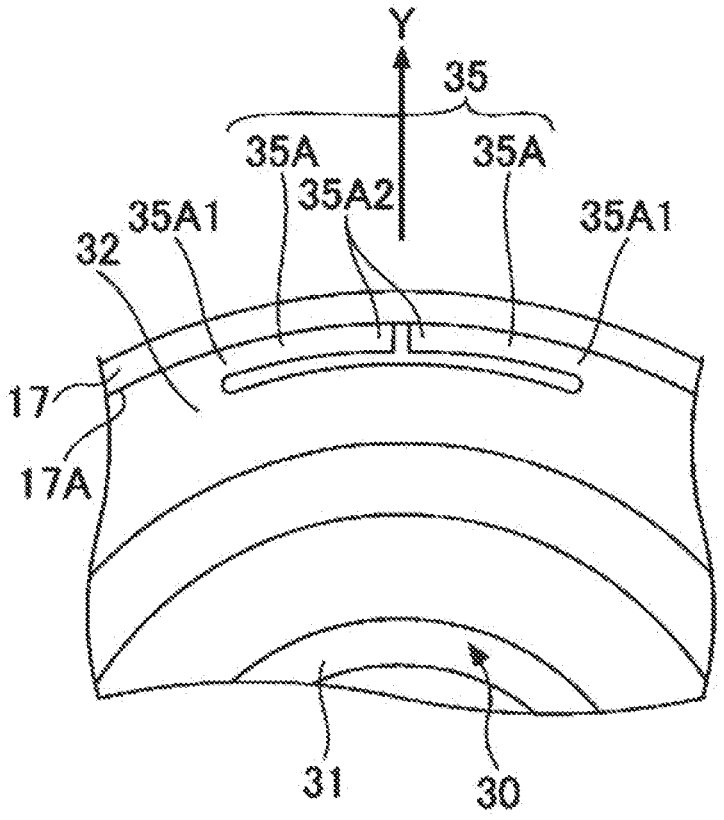
FIG. 3C is an enlarged view illustrating the operation performed by the moving body.

The operation performed by the moving body 30 that is moving in the +Y direction is described below with reference to FIGS. 3A to 3C. FIGS. 3A to 3C are enlarged views illustrating the operation performed by the moving body 30. FIG. 3A illustrates a mode in which the moving body 30 is not moved (a neutral mode in which the amount of movement of the moving body 30 is zero). FIG. 3B illustrates the moving body 30 in a mode in which the moving body 30 is moved and the tip part 35A2 is in contact with the inner peripheral surface 17A. FIG. 3C illustrates the moving body 30 in a mode in which the outer peripheral surface of the leaf spring portion 35A extending from the tip part 35A2 to the base part 35A1 is in contact with the inner peripheral surface 17A.

When the moving body 30 in the neutral mode illustrated in FIG. 3A is moved in the +Y direction and the tip part 35A2 of the leaf spring portion 35A is first brought into contact with the inner peripheral surface 17A as illustrated in FIG. 3B, the tip part 35A2 bends in the radially inward direction of the moving body 30 due to elastic deformation of the leaf spring portion 35A. Thus, the impact force is released, and the collision noise is not generated.

As the moving body 30 is further moved in the +Y direction, the contact point moves continuously from the tip part 35A2 to the base part 35A1 with the outer peripheral surface extending from the tip part 35A2 to the base part 35A1 being in contact with the inner peripheral surface 17A at all times from the time the tip part 35A2 is brought into contact with the inner peripheral surface 17A until the base part 35A1 is brought into contact with the inner peripheral surface 17A, as illustrated in FIG. 3C. In this manner, generation of the collision noise is avoided.

Two leaf spring portions 35A having such a structure are provided so as to be line symmetrical about the Y-axis, and the tip parts 35A2 of the two leaf spring portions 35A face each other with the Y-axis therebetween. As a result, the above-described operations provided by the leaf spring portions 35A are performed by the two leaf spring portions 35A at the same time.

When the base part 35A1 is brought into contact with the inner peripheral surface 17A, the movement of the moving body 30 is restricted, because the base part 35A1 is not deformed.

As described above, when the moving body 30 is moved in the +Y direction, the collision noise is not generated even if the moving body 30 is regulated by being brought into contact with the inner peripheral surface 17A. In addition, since the movement of the moving body 30 in the +Y direction can be reliably regulated at the position of the undeformable rigid region (the base part 35A1), the variation in the amount of stroke of the moving body 30 is reduced, and excellent operation sensation is obtained. This also applies to the operations in the −Y and ±X directions.

In this manner, the operation device 1 can be provided that is capable of absorbing collision noise generated when the moving body 30 and the support portion 10 are brought into contact with each other.

In addition, since the spacing (the distance) G2 between the tip part 35A2 of the leaf spring portion 35A and the inner peripheral surface 17A is set to less than the spacing (the distance) G1 between the base part 35A1 of the leaf spring portion 35A and the inner peripheral surface 17A, the tip part 35A2 is first brought into contact with the inner peripheral surface 17A, thus reducing the collision noise between the moving body 30 and the support portion 10.

In addition, the outer peripheral surface of the leaf spring portion 35A is curved, and the distance between the leaf spring portion 35A and the inner peripheral surface 17A in the movement direction of the moving body 30 is set so as to continuously increase toward the base part 35A1 from the tip part 35A2. Consequently, after the tip part 35A2 is brought into contact with the inner peripheral surface 17A, the outer peripheral surface of the leaf spring portion 35A extending to the base part 35A1 is continuously brought into smooth contact with the inner peripheral surface 17A without separating from the inner peripheral surface 17A. As a result, generation of collision noise between the moving body 30 and the support portion 10 can be effectively avoided.

In addition, by using a leaf spring 35 (the leaf spring portion 35A), elastic deformation can be caused with a simple configuration at the time of contact.

In addition, since the base part 35A1 of the leaf spring portion 35A is provided in the outer peripheral surface of the flange 32, an undeformable rigid region that is continuously located in the leaf spring portion 35A can be provided with a simple configuration. As a result, the movement of the moving body 30 can be reliably stopped by the base part 35A1 at a predetermined position.

In addition, since the leaf spring 35 is provided as an integral part of the moving body 30 so as to be brought into contact with the inner peripheral surface 17A provided as an integral part of the support portion 10, the problem of collision noise generated at the time of contact between the moving body 30 and the support portion 10 can be removed without increasing the number of parts.

In addition, since the leaf springs 35 are line symmetrical about each of the imaginary center lines (the X-axis and Y-axis) extending in the movement direction of the moving body 30, the movement of the moving body 30 can be regulated in a well balanced manner without tilting the moving body 30 with respect to the X-axis and Y-axis when the movement of the moving body 30 is regulated by the base part 35A1.

In addition, since the leaf spring 35 is provided on the outer periphery of the moving body 30 and the inner peripheral surface 17A is provided on the substantially cylindrical wall 17 of the support portion 10 surrounding the moving body 30, the moving body that moves in two axial directions can be efficiently regulated. As can be seen from a structure in which the moving body 30 moves in four axial directions, the efficiency increases with increasing number of axial directions in which the moving body 30 is movable.

In addition, since the leaf spring 35 is divided into two leaf spring portions 35A having two tip parts 35A2 that are not connected to each other, a weld does not occur in the leaf spring portions 35A when the moving body 30 is produced by molding or the like. Thus, the durability is improved, and the configuration is less likely to be broken up than in the case where the tip parts 35A2 are connected to each other.

While the above embodiment has been described with reference to the structure in which the leaf spring 35 is provided in the moving body 30 and the support portion 10 is provided with the wall 17 having the inner peripheral surface 17A with which the leaf spring 35 is brought into contact, the following configuration may be employed. That is, a leaf spring portion deformable in the contact direction of the inner peripheral surface 17A of the support portion 10 may be provided. After the outer peripheral surface of the moving body 30 is brought into contact with the leaf spring portion of the inner peripheral surface 17A, the outer peripheral surface may be continuously brought into contact with the leaf spring portion without separating from the leaf spring portion and, finally, may be brought into contact with the base part (the rigid region) that supports the leaf spring portion.

In addition, while the above embodiment has been described with reference to the configuration in which the X-axis and Y-axis are located in the center between the tip parts 35A2 of the two leaf spring portions 35A, each of the X-axis and Y-axis may be deviated from the center by an amount that does not affect the operation.

In addition, while the above embodiment has been described with reference to the configuration in which the leaf spring 35 has two leaf spring portions 35A, the number of leaf spring portions 35A may be one. In this case, the tip part 35A2 may be located on the X-axis and the Y-axis, and the distance between the leaf spring portion 35A and the inner peripheral surface 17A (in each of the X-axis and Y-axis directions) may be set so as to continuously increase toward the base part 35A1 from the tip part 35A2.

In the case where the number of leaf spring portions 35A is one, either the center between the tip part 35A2 and the base part 35A1 or any part between the tip part 35A2 and the base part 35A1 (an intermediate part) may protrude the most in the radially outward direction of the flange 32, and the part that protrudes the most in the radially outward direction may be located on the X-axis and the Y-axis. In this case, the movement of the moving body 30 may be regulated in the manner described below. That is, when the moving body 30 is moved, the most protruding portion between the tip part 35A2 and the base part 35A1 in the radial direction is brought into contact with the inner peripheral surface 17A, and the portion up to the tip part 35A2 and the portion up to the base part 35A1 are continuously brought into contact with the inner peripheral surface 17A and, finally, the base part 35A1 is brought into contact with the inner peripheral surface 17A.

Second Embodiment

Figure 4:
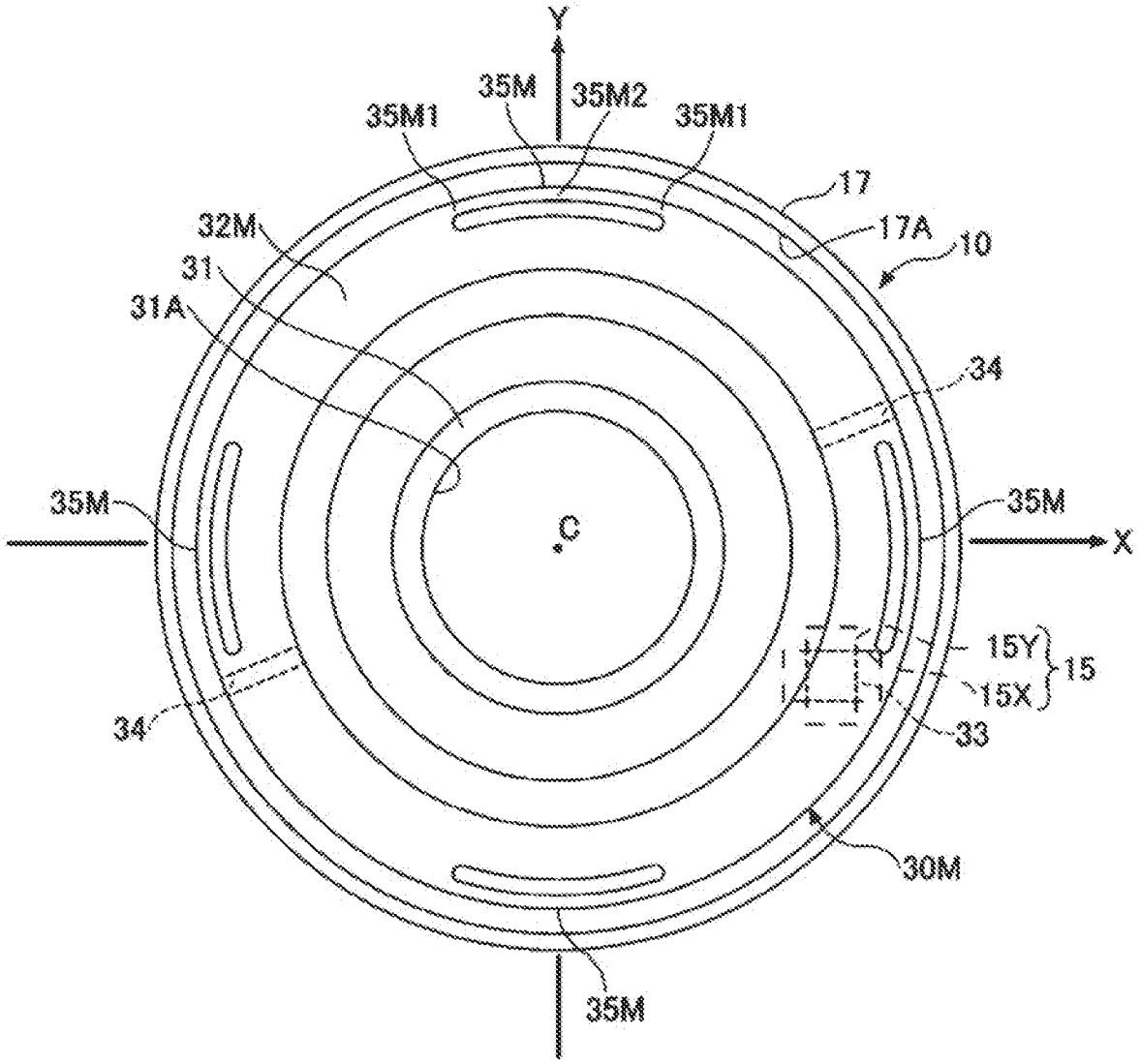
FIG. 4 illustrates a moving body of an operation device according to a second embodiment.

FIG. 4 illustrates a moving body 30M of an operation device according to the second embodiment. The moving body 30M includes a leaf spring 35M instead of the leaf spring 35 of the moving body 30 according to the first embodiment.

The leaf spring 35M has a configuration in which the tip parts 35A2 of the two leaf spring portions 35A according to the first embodiment are connected to each other. More specifically, a flange 32M has a leaf spring 35M. The leaf spring 35M has two base parts 35M1 and an intermediate portion 35M2. The intermediate portion 35M2 is a portion between the two base parts 35M1 and is an elastic region that functions as a double end leaf spring.

The central part of the intermediate portion 35M2 between the two base parts 35M1 protrudes the most in the radially outward direction from the outer peripheral surface of the flange 32M. In this manner, a configuration is achieved that enables the central part of the intermediate portion 35M2 between the two base parts 35M1 of the leaf spring 35M to be first brought into contact with the inner peripheral surface 17A of the wall 17 of the support portion 10 when the moving body 30M is moved in the X and Y directions.

After the central part of the intermediate portion 35M2 of the leaf spring 35M between the two base parts 35M1 is brought into contact with the inner peripheral surface 17A, the outer peripheral surface of the leaf spring 35M is continuously brought into contact with the inner peripheral surface 17A toward each of the base parts 35M1 without separating from the inner peripheral surface 17A and, finally, the two base parts 35M1 are brought into contact with the inner peripheral surface 17A. Thus, the movement is regulated. As a result, the collision noise generated when the moving body 30 and the support portion 10 are brought into contact with each other can be absorbed.

Note that the intermediate portion 35M2 of the leaf spring 35M may be located at the same position in the radial direction across the zone between the two base parts 35M1. Even such a configuration enables the outer peripheral surface of the leaf spring 35M to be continuously brought into contact with the inner peripheral surface 17A toward the base part 35M1 after the central part of the intermediate portion 35M2 of the leaf spring 35M between the two base parts 35M1 is brought into contact with the inner peripheral surface 17A. Thus, the collision noise generated when the moving body 30 and the support portion 10 are brought into contact with each other can be absorbed.

While the operation devices according to exemplary embodiments of the present invention have been described above, the present invention is not limited to the embodiments particularly disclosed, and various modifications and changes can be made without departing from the scope of the claims.

What is claimed is:

1. An operation device comprising:

a support portion;

a moving body operated by an operator and movably supported by the support portion;

a detection unit configured to detect movement of the moving body; and contact portions respectively provided on the support portion and the moving body, the contact portions being brought into contact with each other, wherein the contact portion of one of the support portion and the moving body has:

an elastic region that is first brought into contact with the contact portion of the other of the support portion and the moving body when the contact portions are brought into contact with each other; and a rigid region provided adjacent to the elastic region and continuously brought into contact with the contact portion of the other of the support portion and the moving body following the contact of the elastic region to regulate the movement of the moving body, and the contact portions are provided on a substantially cylindrical outer peripheral surface of the moving body and on a substantially cylindrical inner peripheral surface of the support portion surrounding the moving body, respectively.

2. The operation device according to claim 1, wherein a distance between the elastic region of the contact portion of the one of the support portion and the moving body and the contact portion of the other of the support portion and the moving body is set to less than the distance between the rigid region of the contact portion of the one of the support portion and the moving body and the contact portion of the other of the support portion and the moving body.

3. The operation device according to claim 1, wherein an outer surface of the contact portion of the one of the support portion and the moving body is a curved surface, and wherein the distance between the contact portion of the one of the support portion and the moving body and the contact portion of the other of the support portion and the moving body continuously increases toward the rigid region from the elastic region.

4. The operation device according to claim 1, wherein the elastic region of the contact portion is a leaf spring elastically deformable in a movement direction of the moving body.

5. The operation device according to claim 4, wherein the rigid region of the contact portion is a base part that supports one end of the leaf spring.

6. The operation device according to claim 1, wherein the contact portion of the one of the support portion and the moving body is provided as an integral part of the one of the support portion and the moving body, and wherein the contact portion of the other of the support portion and the moving body is provided as an integral part of the other of the support portion and the moving body.

7. The operation device according to claim 1, wherein the contact portion is line symmetrical about an imaginary center line extending in a movement direction of the moving body.

8. The operation device according to claim 1, wherein the elastic region of the contact portion is configured with a first spring and a second spring that are elastically deformable in a movement direction of the moving body.

9. The operation device according to claim 8, wherein the first and second springs are line symmetrical about an imaginary center line extending in the movement direction of the moving body.

* * * * *